US005233770A

United States Patent [19]

Robinson

[11] Patent Number: 5,233,770

[45] Date of Patent: Aug. 10, 1993

[54] LOCKING PIN APPARATUS

[75] Inventor: Howard W. Robinson, Grapevine, Tex.

[73] Assignee: GH Hensley Industries, Inc., Dallas, Tex.

[21] Appl. No.: 807,714

[22] Filed: Dec. 16, 1991

[51] Int. Cl.[5] ..... E02F 9/28

[52] U.S. Cl. ..... 37/456; 37/452; 403/374; 403/409.1

[58] Field of Search ..... 37/141 T, 142 R, 142 A; 403/374, 409.1; 172/750; 411/508, 356

[56] References Cited

U.S. PATENT DOCUMENTS

| | | | |
|---|---|---|---|
| 564,664 | 7/1896 | Trim et al. . | |
| 2,039,058 | 4/1936 | Cooke | 403/374 X |
| 2,901,845 | 9/1959 | Whisler | 37/142 A |
| 3,022,586 | 2/1962 | Towne | 37/142 A |
| 3,121,289 | 2/1962 | Eyolfson | 37/142 R |
| 3,440,745 | 5/1966 | Palm | 37/141 R |
| 3,520,076 | 7/1967 | Nichols | 37/141 R |
| 3,832,077 | 8/1974 | Von Mehren | 403/379 |
| 4,069,731 | 1/1978 | Stang | 403/409.1 X |
| 4,187,035 | 2/1980 | Colburn | 403/318 |
| 4,231,173 | 11/1980 | Davis | 37/142 R |
| 4,296,530 | 10/1981 | Muller et al. | 403/409.1 X |
| 4,335,532 | 6/1982 | Hahn et al. | 37/142 R |
| 4,404,760 | 9/1983 | Hahn et al. | 37/142 R |
| 4,501,079 | 2/1985 | Hahn et al. | 37/141 R |
| 4,577,423 | 3/1986 | Hahn | 37/142 R |
| 4,602,445 | 7/1986 | Nilsson | 37/142 A |
| 4,716,667 | 1/1988 | Martin | 37/142 R |
| 4,761,900 | 8/1988 | Emrich | 37/142 A |
| 5,074,062 | 12/1991 | Hahn et al. | 37/142 A |

*Primary Examiner*—David H. Corbin
*Assistant Examiner*—Arlen L. Olsen
*Attorney, Agent, or Firm*—Hubbard, Thurman, Tucker & Harris

[57] ABSTRACT

A one-piece locking pin (100) for use captively retaining a tooth (14) on an adapter portion (12) of an excavating tooth and adapter assembly has a primary wedge member (110) with an integral spring (120) extending upward from the member's distal end (116). A first positive stop member (130) extends from the wedge member (110) while an opposing second positive stop member (122) extends from the integral spring (12). After insertion, the locking pin (100) prevents separation of tooth (14) from adapter portion (12) while the first and second positive stop member (130, 122) prevent accidental loss of the locking pin (100) from the assembly. To remove the locking pin, a force sufficient to separate the first positive stop member (130) from the pin (100) is exerted to drive the pin (100) from the assembly.

18 Claims, 5 Drawing Sheets

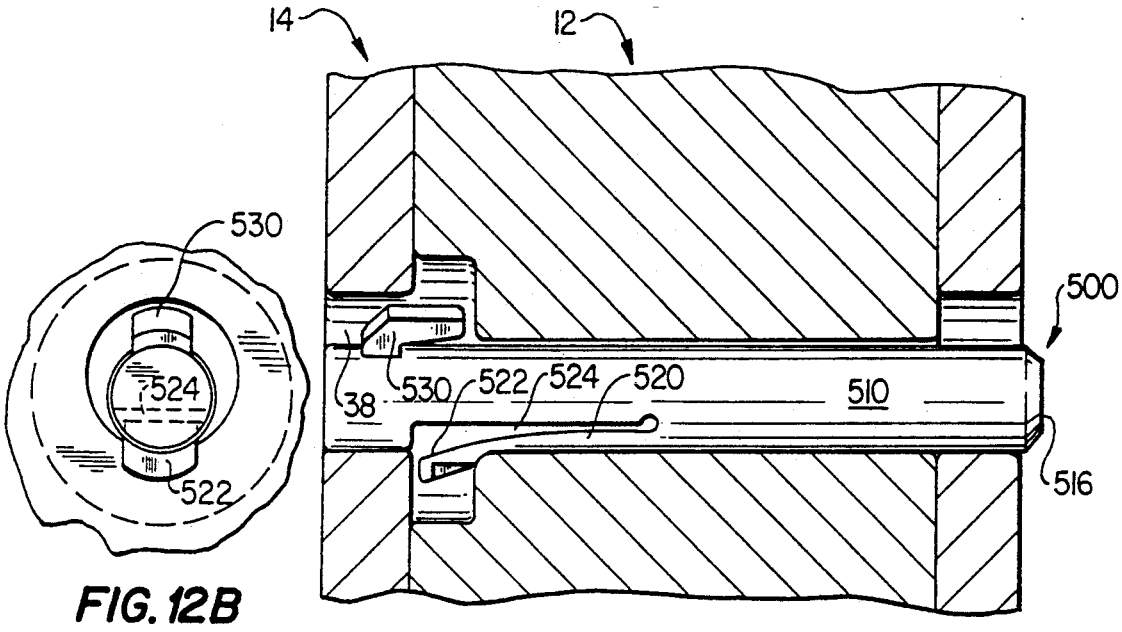
FIG. 12B
FIG. 12A
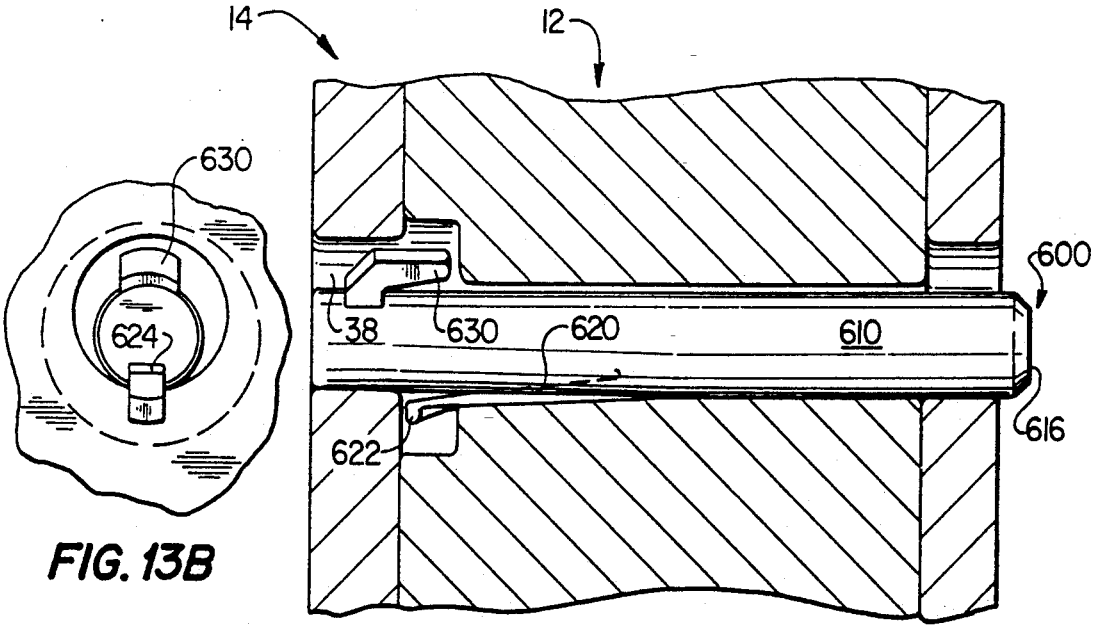
FIG. 13B
FIG. 13A

LOCKING PIN APPARATUS

TECHNICAL FIELD OF THE INVENTION

The present invention relates generally to earth excavating equipment, and more particularly provides an improved one piece locking pin apparatus that is used to captively retain a replaceable excavating tooth point on the nose portion of an adapter which, in turn, is secured to the forward lip of an excavating bucket or the like.

BACKGROUND OF THE INVENTION

Excavating tooth assemblies provided on digging equipment such as excavating buckets or the like typically comprise a relatively massive adapter portion which is suitably anchored to the forward bucket lip and has a reduced cross-section, forwardly projecting nose portion, and a replaceable tooth point having formed through a rear end thereof a pocket opening that releasably receives the adapter nose. To captively retain the point on the adapter nose, aligned transverse openings are formed through these interengageable elements adjacent the rear end of the point, and a device commonly referred to as a flex pin or locking pin is driven into these openings.

While locking pins have a variety of configurations, a widely used version, as representatively illustrated in U.S. Pat. No. 3,526,049 to Nichols and U.S. Pat. No. 3,685,178 to Ratkowski, typically comprises elongated, straight metal locking and wedge members which are laterally spaced apart and intersecured by an elongated central elastomeric element. As the locking pin is being driven into the aligned point and adapter nose openings the elastomeric element is compressed and, when the pin is driven to its installed position, laterally urges a detent portion formed on one of the two metal portions of the point into engagement with a suitably configured portion of the adapter nose to captively retain the flex pin within the point and adapter openings. With the flex pin in its operative position within such openings, the elastomeric element is in a state of partial compression, rear surfaces of the tooth point openings bear against opposite end portions of the locking member, and a forward surface of the adapter nose opening bears against a longitudinally central portion of the wedge member. Forwardly directed tooth point removal forces encountered during the excavating process cause the tooth point to be driven forwardly relative to the adapter to thereby move the locking member closer to the elastomeric element, the opposite ends of the locking member preventing forward removal of the tooth point.

Two primary problems and disadvantages are present in this type of conventional flex pin construction—each of which is related to failure of the central elastomeric element. First, as the flex pin is being driven into the aligned tooth point and adapter nose openings the locking and wedge members tend to be moved longitudinally relative to one another. Thus, if the driving-in process is not carefully performed, this relative longitudinal movement can easily shear the elastomeric element, thereby ruining the flex pin. Secondly, excessive forwardly directed tooth point removal loads can laterally move the locking member close enough to the wedge member to overcompress and thereby split the elastomeric element.

Various attempts have previously been made to better protect the critical central elastomeric portion of the flex pin by altering the essentially straight configuration of the locking and wedge member portions utilized in flex pin structures such as those depicted in the Nichols and Ratkowski patents. One such proposed solution, as exemplified in U.S. Pat No. 4,192,089 to Schwappach and U.S. Pat. No. 4,446,638 to Novotny et al., is to form a central lateral recess in a front side portion of the locking member and to shorten the wedge member so that it is laterally movable into such recess against the resilient force of the central elastomeric element. With the elastomeric element in an uncompressed condition the opposite ends of the wedge member underlie the opposite end surfaces of the recess so that as the flex pin is being driven into the point and adapter openings one of the wedge member ends is driven into engagement with its adjacent recess end surface. This limits the relative longitudinal travel between the locking and wedge members to thereby limit the shear stress imposed upon the elastomeric element.

In an attempt to similarly limit the lateral compressive stress imposed on the elastomeric element, the maximum distance which the wedge member may be laterally moved into the locking member recess is limited to a distance less than the front-to-rear thickness of the elastomeric element by causing opposite end portions of the wedge member to rigidly engage portions of the locking member during travel of the wedge member into the locking member recess. In the Schwappach patent this inward travel limitation is achieved by forming on the opposite wedge member ends rearwardly directed projections which are engageable with the rear side surface of the locking recess. In the Novotny et al patent a similar result is achieved by forming forwardly facing shoulders posited adjacent opposite ends of the recess which are adapted to rigidly engage opposite end portions of the wedge member during its lateral travel into the recess. Somewhat similar schemes for protecting elastomeric flex pin portions are evidenced in U.S. Pat. No. 2,927,387 to Drover and U.S. Pat. No. 3,126,654 to Eyolfson et al.

While this conventional method of limiting lateral compression of the elastomeric element represents an improvement over somewhat simpler flex pin structures such as those depicted in the Nichols and Ratkowski patents, it creates significant structural problems in the wedge member. Specifically, when the wedge member is moved to its "stopped" position within the locking member recess a large rigid bending load is imposed thereon by the forward surface of the adapter nose opening which bears against a central rear side portion of the wedge member. To adequately strengthen the wedge member against such bending load it is necessary to appropriately increase its front-to-rear thickness. This thickening, in turn, typically requires that undesirable design modifications be made to one or all of the elastomeric elements, the locking member and the adapter nose opening.

Specifically, it is well known that the overall strength of an adapter nose is, generally speaking, inversely proportional to the size of the flex pin opening formed therethrough. Thus, if it is desired to maintain a given front-to-rear length of the adapter nose opening, the necessary thickening of the wedge member requires that the front-to-rear thickness of one or both of the elastomeric element and the locking member be correspondingly reduced. Reducing the thickness of the locking member, of course, structurally weakens the flex pin, while reducing the thickness of the elastomeric element reduces the resiliency of the flex pin and the potential lateral travel between its rigid elements. Of course, neither of these results is desirable.

If, on the other hand, the front-to-rear thickness of the elastomeric element and the locking member are maintained, the thickening of the wedge member requires that the front-to-rear length of the adapter nose opening be correspondingly increased. This, of course, undesirably weakens the adapter nose.

Therefore, a need exists for a locking pin which eliminates the use of an elastomeric element altogether. Such a locking pin would not experience the problems of dimensional limitations due to the thickness of the elastomeric element. Nor would it be limited to environments safe for elastomeric materials. A need exists for a one-piece locking pin, thereby eliminating the need to store various elements at the job site. A one-piece design would also limit the risk of error in installing the locking pin.

SUMMARY OF THE INVENTION

A locking pin assembly is provided which overcomes many of the disadvantages found in the prior art. Namely, the preferred embodiment of the present locking pin does not involve multiple elements, instead its one-piece design allows for easier storage at the job site and easier installation and removal. The preferred embodiment can be formed by metal casting thereby eliminating the use of any elastomeric material. This allows the locking pin to be used around caustic or hot environments where prior art locking pins can fail.

The locking pin of the present invention has a generally elongated shape with a proximal end and a distal end. The proximal end serves as an impact surface while the distal end is dimensioned to guide the locking pin during insertion. A first positive stop means can extend outward from the proximal end of the pin. This first positive stop means limits the travel of the pin during insertion. An integral spring is formed by a planar extension angled from the pin and extending upward from the distal end. The integral spring allows for compression during insertion, but resumes its normal position after insertion. A second positive stop means extends from the integral spring. This second stop means prevents removal of the pin from a direction opposite to the direction of insertion. Therefore, to remove the locking pin after its insertion, a sufficient force must be applied to the pin's proximal end to break off the first stop means. This allows the pin to then be driven through the interengaged tooth and adapter.

In an alternative enbodiment, the locking pin also incorporates vibration dampening means. This dampening means may be either an elastomeric element or a second integral spring. In another embodiment, the pin is provided with a circular cross-section.

BRIEF DESCRIPTION OF THE DRAWINGS

For a more complete understanding of the present invention, and for further details and advantages thereof, reference is now made to the following Detailed Description taken in conjunction with the accompanying drawings, in which.

FIGS. 12A and 12B illustrate a one-piece locking pin with circular cross-section and a secant integral spring groove; and FIGS. 13A and 13B illustrate a one-piece locking pin with a circular cross-section and a U-shaped integral spring groove.

DETAILED DESCRIPTION

Figure 1:
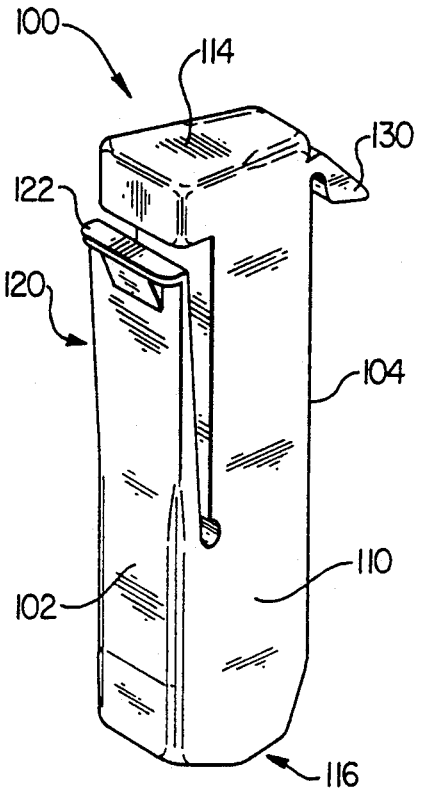
FIG. 1 is a perspective of the one-piece locking pin.

The present invention relates to an improved one-piece locking pin apparatus that is used to captively retain a replaceable excavating tooth point on the nose portion of an adapter which, in turn, is secured to the forward lip of an excavating bucket or the like. Referring to FIG. 1, a locking pin 100 embodying the present invention is shown in perspective. Pin 100 is comprised of a wedge member 110 with a proximal end 114 and a distal end 116. An integral spring 120 is formed on a first side 102 of wedge member 110 while a first positive stop means 130 extends from an opposite side 104 of wedge member 110. Pin 100 can be made of 4140 steel or similar metal such that integral spring 120 cannot be over stressed past its yield point.

Figure 2:
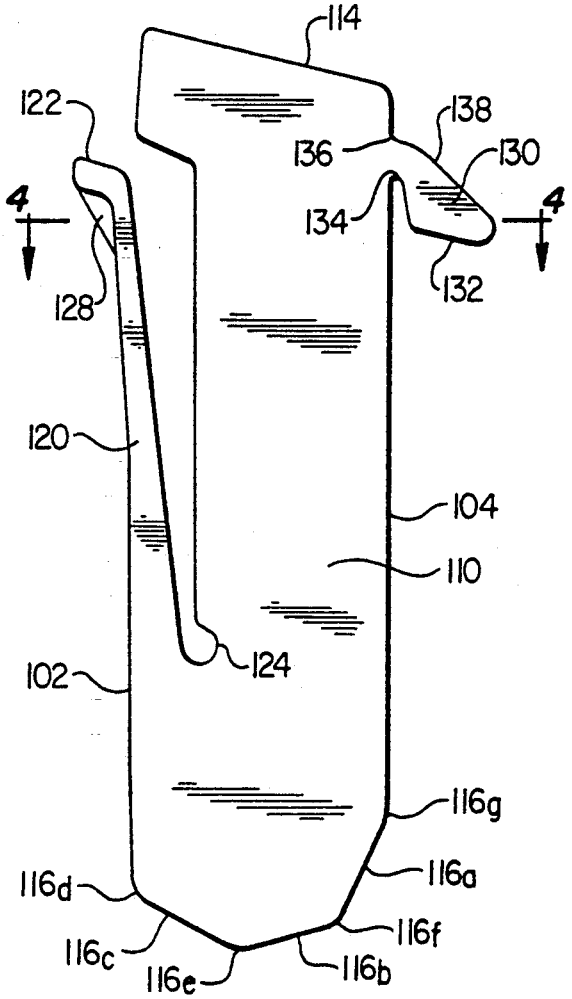
FIG. 2 is a side view of the one-piece locking pin.

Referring to FIGS. 1 and 2 simultaneously, locking pin 100 has a generally rectangular shape. Proximal end 114 is typically flat while distal end 116 comprises several angled surfaces **116*a*, 116*b*, and 116*c*. As will be discussed in greater detail, end 114 acts as an impact surface while end surfaces 116*a*, 116*b*, and 116*c* act to guide locking pin 100 into position between an adapter and a replaceable tooth. A first distal angle exists between the first surface 102 and the first distal surface 116*c*, a second distal angle exists between the first and third distal surfaces 116*c*, 116*b*, a third distal angle exists between the second and third distal surfaces 116*b*, 116*a*, and a fourth distal angle exists between the second surface 104 and the second distal surface 116*a*. Each of said first, second, third, and fourth distal angles are being greater than or equal to 90 degrees. The first positive stop means 130 may have a stop surface 132 and a slide surface 138. The distance between connection points 134 and 136 is small, thereby making the first positive stop means 130** frangible.

Integral spring 120 extends outward from side 102 of wedge member 110 The integral spring 120 can be connected to the wedge member 110 generally near its distal end 116. The integral spring 120 is typically a resilient, planar member with a second positive stop means 122 at its proximal end. Integral spring 120 may flex inward toward wedge member 110 during its insertion. Due to its resilient nature, the integral spring 120 will resume its normal position upon reaching a locking position. Stress relief surface 124 deters crack formation and propagation between the spring 120 and the wedge member 110. A support 128 formed on spring 120 deters the deformation of second positive stop means 122.

Figure 3:
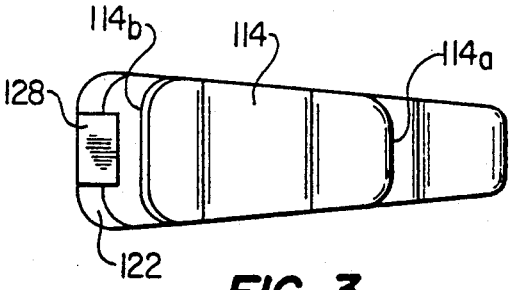
FIG. 3 is a top view of the proximal end of the one-piece locking pin.
Figure 4:
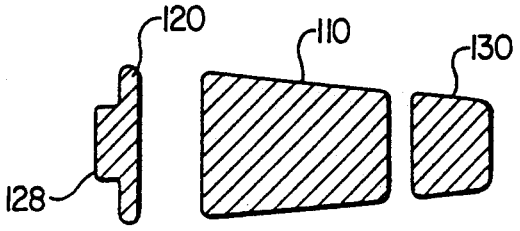
FIG. 4 is a sectional view across section line 4—4 in FIG. 2.

FIGS. 3 and 4 illustrate the trapezoidal cross-section of this embodiment of the locking pin 100. Proximal end 114 is best shown in FIG. 3. Side 114*a* of proximal end 114 is narrower than side 114*b*. This "key" effect prevents the improper insertion of the locking pin 100. FIG. 4 illustrates a sectional view across section line 4—4 in FIG. 2. The spacing between integral spring 120, wedge member 110 and first positive stop means 130 is clearly shown.

FIGS. 5 through 8 illustrate a method of inserting the locking pin 100 into a forward end portion of an excavating tooth and adapter assembly 10 which includes an adapter portion 12, and a replaceable tooth point 14 which is removably secured to the adapter. The adapter has a rearwardly disposed base portion 18 which may be suitably secured to the lower forward lip of an excavating bucket or the like (not illustrated) to support the point of tooth 14 in a forwardly projecting orientation relative to the bucket lip. Together with other similar tooth and adapter assemblies, the assembly 10 defines the digging tooth portion of the overall excavating apparatus.

The tooth 14 is provided with vertically tapered upper and lower side wall portions 20 and 22 which converge at the forward end to a point (not shown) to define a cutting edge. Extending forwardly through the rear end 26 of tooth 14 is a vertically tapered pocket opening 28 that receives a complementarily tapered nose portion 30 which projects forwardly from the adapter base 18 and defines therewith a forwardly facing peripheral shoulder portion 32 that faces and is spaced slightly rearwardly from the rear end 26 of the tooth 14.

Figure 6:
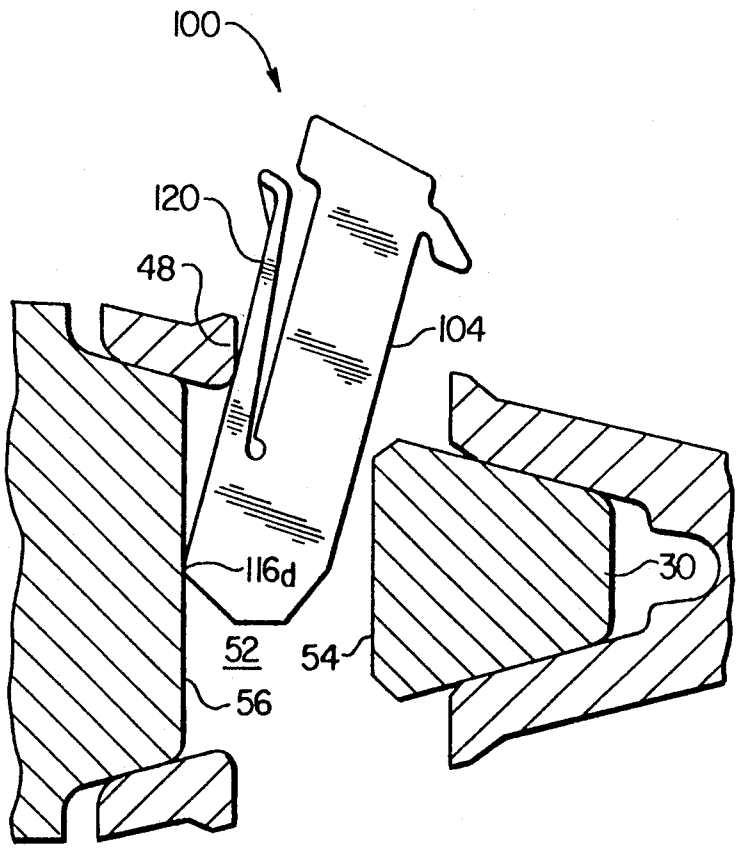
FIGS. 5–8 illustrate the steps of inserting the one-piece locking pin between the adapter portion and the replaceable tooth.
Figure 5:
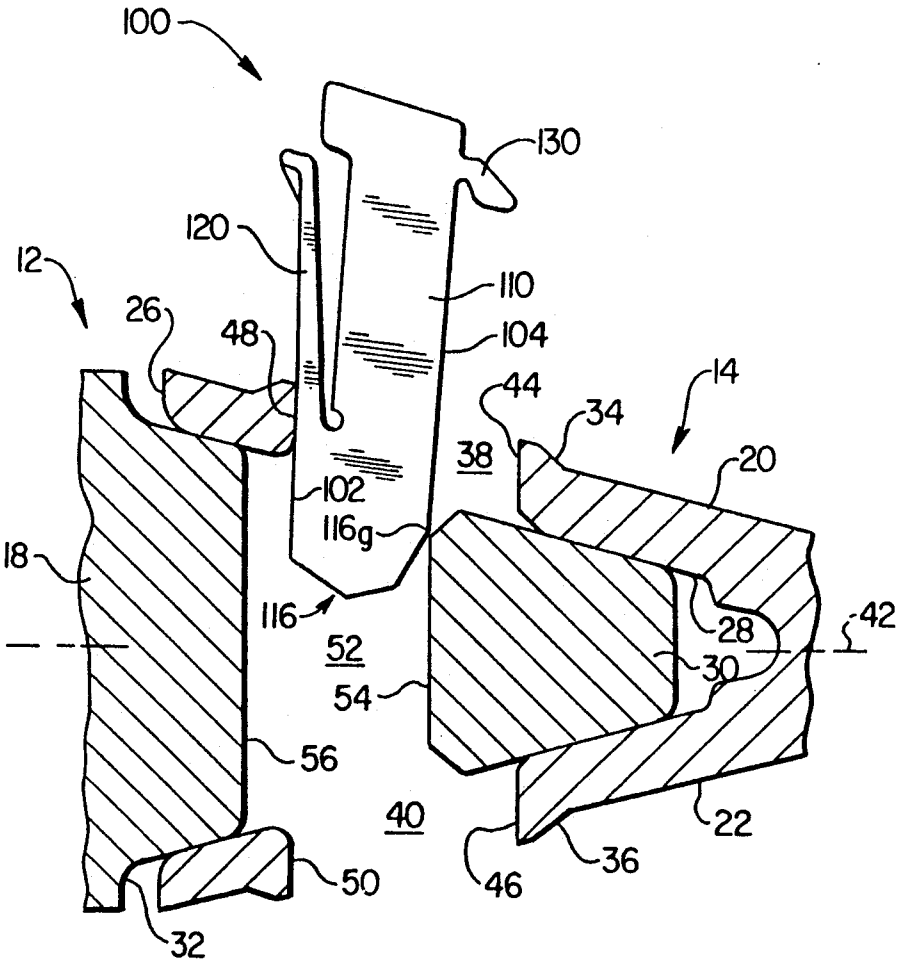

The tooth 14 is respectively provided along its upper and lower side walls 20 and 22 with raised reinforcing portions 34 and 36 through which aligned, generally rectangular cross-sectioned openings 38 and 40 are respectively formed. Openings 38 and 40 are elongated in a direction parallel to the longitudinal axis 42 of the assembly 10 and have forward end surfaces 44 and 46 which are generally perpendicular to axis 42, and forwardly and outwardly sloped rear surfaces 48 and 50. Aligned with the tooth point openings is a generally rectangularly cross-sectioned opening 52 extending vertically through the adapter nose 30. Opening 52 has an essentially flat rear end wall 54, and a forward end wall 56. The present locking pin 100 is received in the aligned tooth and adapter nose openings 38, 40 and 52 and functions in a manner subsequently described to captively retain the tooth 14 on the adapter nose 30 and prevent its separation therefrom. FIG. 5 shows the initial insertion of distal end 116 of locking pin 100 through tooth opening 38 and into adapter opening 52. Integral spring 120 contacts outwardly sloped rear surface 48 of tooth 14. Point 116*a* of the distal end of locking pin 100 contacts surface 54 of tapered nose portion 30. Upon further insertion into adapter opening 52, the locking pin 100 tilts, thereby producing contact between distal point 116*d* to rearward wall 56, as shown in FIG. 6. Wedge member side 104 contacts surface 54 of tapered nose portion 30. Outwardly sloped rear surface 48 moves upward along integral spring 120.

Figure 7:
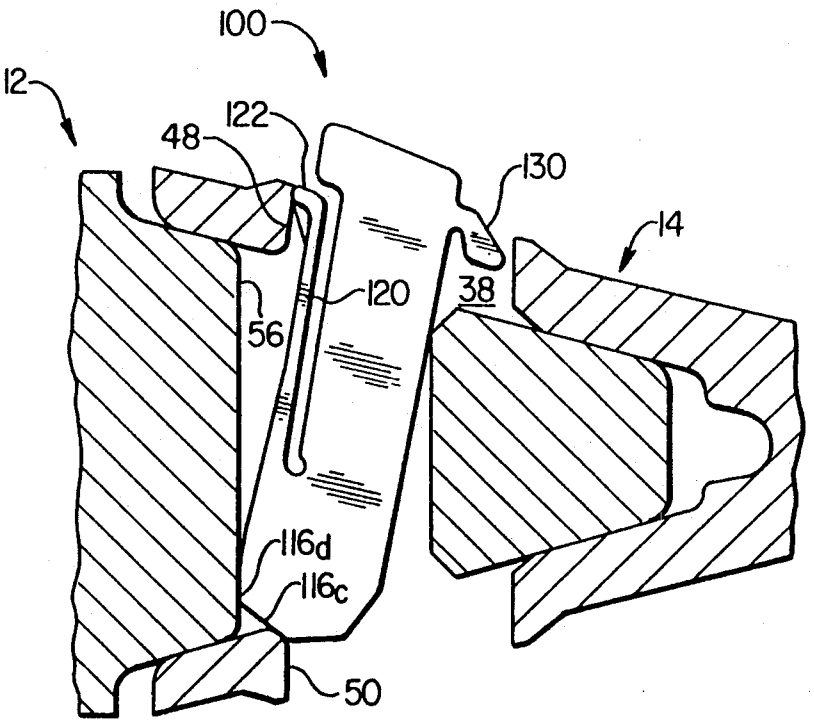

FIG. 7 shows the locking pin 100 in almost a completely inserted position. Outwardly sloped rear surface 48 contacts second positive stop means 122 as integral spring 120 is forced to a compressed position. First positive stop means 130 enters opening 38 in tooth 14. Also, distal point 116*d* moves lower on rearward wall 56 while distal surface 116*c* contacts sloped rear surface 50. Further downward force exerted on locking pin 100 causes the pin to straighten due to the taper of distal surface 116*c*. This straightening causes second positive stop means 122 to further slide downward on rear surface 48.

Figure 8:
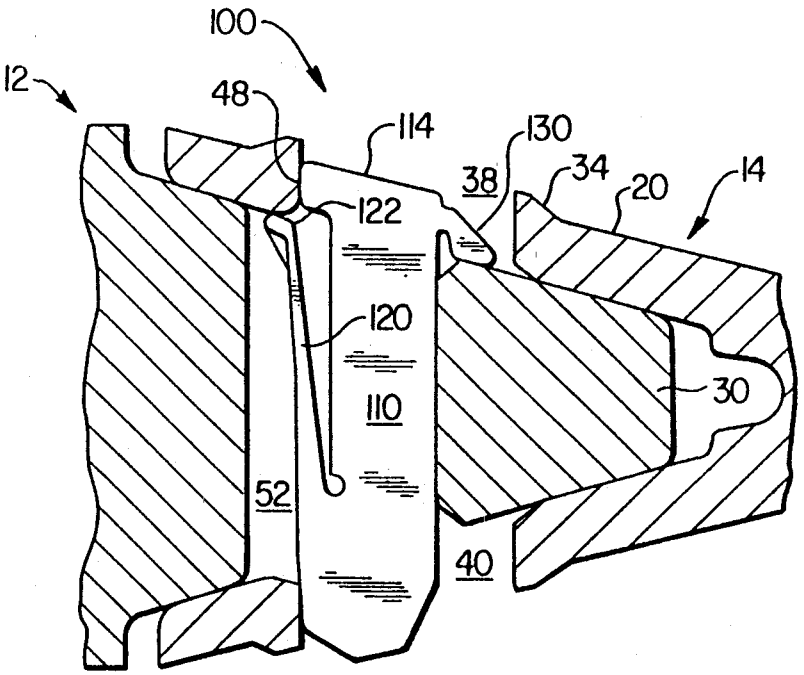

After a predetermined distance of slide the second positive stop means 122 disengages rear surface 48 and integral spring 120 returns to its non-compressed position as shown in FIG. 8. Simultaneously, first positive stop means 30 contacts nose portion 30. Furthermore, the distal portion of surface 102 engages rearward surface 50. In its final insertion position, locking pin 100 is incapable of being forced further into openings 38, 40 or 52 without extreme deformation of either first positive stop means 130 or adapter nose 30. Nor can the locking pin 100 be withdrawn from openings 38, 40 or 52 without extreme deformation of integral spring 120 or second positive stop means 122. Therefore, the pin 100 is locked into position and prevents the separation of adapter 12 from tooth 14. To remove locking pin 100 from this position, a predetermined force must be applied to surface 114 to break first positive stop means 130 from the wedge member 110, thereby allowing the pin 100 to be completely driven through opening 40. Note that proximal surface 114 is positioned below the height of either upper side wall portion 20 or raised reinforcing portion 34. Thus, the proximal surface 114 is protected from unwanted impact which could accidently break off first positive stop means 130. Also, during insertion, the inserter can easily determine when to stop applying force to the proximal surface 114 based upon a visual inspection of its position.

Figure 9A:
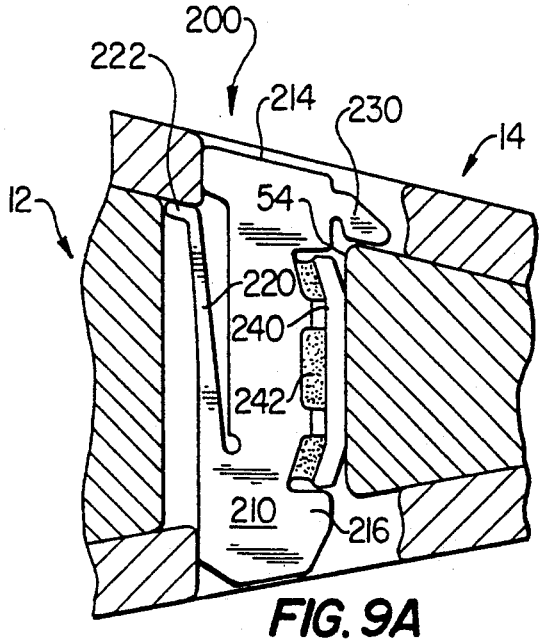
FIG. 9A and 9B disclose an alternate locking pin embodiment with vibration dampening elements.
Figure 9B:
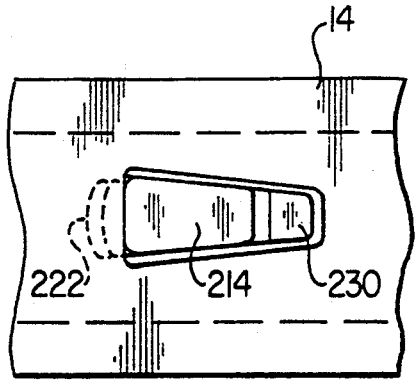

FIGS. 9A and 9B illustrate locking pin 200, an alternative embodiment of the invention. While this pin 200 is not a single-piece unit, it shares many of the same features of pin 100. For example, pin 200 as a proximal end 214 and a distal end 216 dimensioned to aid in the insertion of the pin between adapter 12 and tooth 14. Locking pin 200 further has a first and second positive stop means 230, 222 similar in shape and function to those described for locking pin 100. However, pin 200 has additional vibration dampening features including bearing element 240. Bearing element 240 can be attached to wedge member 210 by at least one resilient member 242. These resilient members 242 can be made of materials including neoprene or other vibration dampening materials. Bearing element 240, upon insertion, firmly contacts rear end wall 54. Thus, vibration from the normal use of the excavating equipment may be transmitted from the tooth to the locking pin 200, whereupon it is largely diminished prior to its transmission to adapter 12.

Figure 10A:
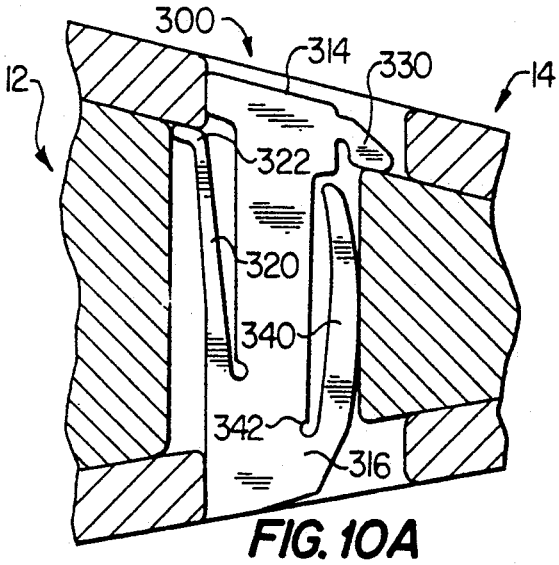
FIG. 10A and 10B disclose an alternate one-piece locking pin embodiment with vibration dampening elements.
Figure 10B:
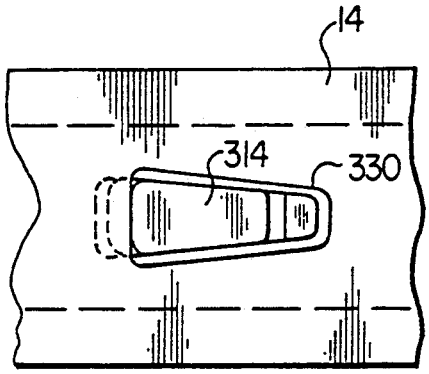

FIGS. 10A and 10B illustrate yet another alternate embodiment. Locking pin 300, again has similar features to pin 100, including a proximal end 314 and distal end 316 dimensioned to aid in the insertion of the pin between adapter 12 and tooth 14. Locking pin 300 controls vibration with a second integral spring 340 which firmly contacts rear end wall 54 after insertion. Second integral spring 340 extends upward from distal end 316 in a generally curved fashion. Stress relief surface 342 is provided to deter crack formation and propagation. Again, as vibration is transmitted from tooth 14 to pin 300, second integral spring 340 minimizes transmission of said vibration from pin 300 to adapter 12. Locking pin 300 is removed in similar fashion to each locking pin described. Excess force is applied to proximal end 314, breaking first positive stop means 330 from the pin. The pin 300 may then be driven through the assembly, thereby allowing removal and replacement of tooth 14.

Figure 11A:
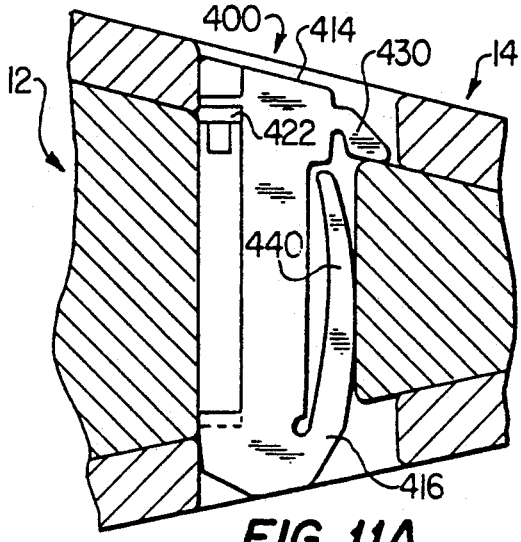
FIGS. 11A and 11B disclose an alternate one-piece locking pin embodiment with vibration dampening elements and perpendicularly disposed first and second stop means.
Figure 11B:
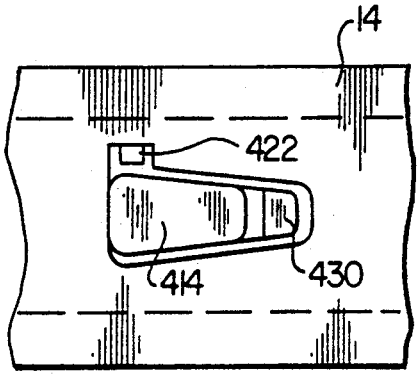

FIGS. 11A and 11B disclose yet another variation of the present invention with locking pin 400. Locking pin 400 also has a second integral spring means 440 extending from the distal end 416. However, a second positive stop means 422 extends perpendicularly from wedge member 410. This relationship is better shown in FIG. 11B. This configuration allows for a slightly wider locking pin.

FIGS. 12A and 12B and FIGS. 13A and 13B disclose horizontal locking pin embodiments 500 and 600. Both embodiments feature a generally circular cross-section with an integral spring 520, 620 extending upward from a midsection of wedge members 510, 610. Integral spring 520, shown in FIGS. 12A and 12B, comprises the entire arc formed by secant groove 524 which divides the integral spring 520 from the wedge member 510. FIGS. 13A and 13B illustrate an integral spring 620 separated from the wedge member 610 by a U-shaped groove 624. Both embodiments utilize a first positive stop means 530, 630 and a second positive stop means 522, 622 as in previously described embodiments. Both first positive stop means are located in opening 38. Thus, circular locking pins 500, 600 cannot rotate sufficiently to allow integral spring means 520, 620 to escape through opening 38. Note also that first stop means 530, 630 do not contact adapter 12 when inserted. Instead, contact occurs only when the locking pins 500, 600 are forced further into the assembly than normal. In order to drive locking pins 500, 600 out of position, a tool adapted to insert into opening 38 must contact the pins. Force is then applied to cause first stop means 530, 630 to contact adapter 12 and break off. The pin may then be driven out of the assembly.

Although preferred embodiments of the invention have been described in the foregoing Detailed Description and illustrated in the accompanying drawings, it will be understood that the invention is not limited to the embodiments disclosed, but is capable of numerous rearrangements, modifications and substitutions of parts and elements without departing from the spirit of the invention. Accordingly, the present invention is intended to encompass such rearrangements, modifications and substitutions of parts and elements as fall within the spirit of the scope of the invention.

I claim:

1. A locking pin for captively retaining a tooth point to an adapter portion of an excavating tooth and adapter assembly comprising:

(a) a wedge member with a distal end, a proximal end, a first surface, and a second surface wherein said distal end of said wedge comprises:
  (i) a first distal surface adjacent to said first surface;
  (ii) a second distal surface adjacent to said second surface; and
  (iii) a third distal surface between said first and second distal surfaces;

(b) an integral spring extending from a first side of said wedge member, wherein said integral spring means comprises a planar member extending upward from the distal end of the wedge member;

(c) a first positive stop means extending from a second side of said wedge member; and (d) a second positive stop means extending outwardly from said integral spring having an upwardly facing engagement surface.

2. The locking pin of claim 1 wherein said wedge comprises an element with a tapered cross-section.

3. The locking pin of claim 1 wherein said wedge comprises an element with a generally circular cross-section.

4. The locking pin of claim 1 wherein said first positive stop means extends from the proximal end of said wedge member.

5. The locking pin of claim 1 wherein said first side is opposite from said second side.

6. The locking pin of claim 1 wherein said first side is adjacent to said second side.

7. The locking pin of claim 1 wherein said first positive stop means comprises a central body with a stop surface dimensioned to prevent insertion into said adapter assembly beyond a predetermined distance.

8. The locking pin of claim 1 wherein said second positive stop means comprises a rigid outwardly projecting portion formed on the proximal end of said planar member.

9. The locking pin of claim 1 wherein said second positive stop means is dimensioned to prevent removal of said locking pin from said adapter assembly once inserted.

10. The locking pin of claim 1 wherein said distal end of said wedge comprises a plurality of angled surfaces dimensioned to guide said locking pin through said adapter assembly.

11. The locking pin of claim 1 wherein said distal end further comprises said first, said second, and said third distal surface such that a first distal angle exists between the first surface and the first distal surface, a second distal angle exists between the first and third distal surfaces, a third distal angle exists between the second and third distal surfaces, and a fourth distal angle exists between the second surface and the second distal surface, each of said first, second, third, and fourth distal angles being greater than or equal to 90 degrees.

12. A locking pin for captively retaining a tooth point to an adapter portion of an excavating tooth and adapter assembly comprising:

(a) a wedge member with a tapered cross-section, a proximal end, and a distal end, said distal end comprising a plurality of angled surfaces dimensioned to guide said locking pin into said adapter assembly;

(b) an integral spring means extending upward from the distal end of said wedge member on a first surface of said wedge member;

(c) a first positive stop means extending from a second surface of said wedge member dimensioned to prevent insertion into said adapter assembly beyond a predetermined distance; and (d) a second positive stop means extending from said integral spring comprising a rigid outwardly projecting portion, formed on a proximal end of said integral spring adjacent the proximal end of said wedge member, having an upwardly facing engagement surface.

13. The locking pin of claim 12 wherein said integral spring means comprises a planar member extending upward from the distal end of the wedge member.

14. The locking pin of claim 12 wherein said first side is opposite from said second side.

15. The locking pin of claim 12 wherein said distal end of said wedge comprises:

(a) a first distal surface adjacent to said first surface;

(b) a second distal surface adjacent to said second surface; and (c) a third distal surface between said first and second distal surfaces.

16. The locking pin of claim 12 wherein said distal end further comprises a first, second, and third distal surface such that a first distal angle exists between the first surface and the first distal surface, a second distal angle exists between the first and third distal surfaces, a third distal angle exists between the second and third distal surfaces, and a fourth distal angle exists between the second surface and the second distal surface, each of said first, second, third, and fourth distal angles being greater than or equal to 90 degrees.

17. A locking pin for captively retaining a tooth point to an adapter portion of an excavating tooth and adapter assembly comprising:

(a) a wedge member with a tapered cross-section, a proximal end, a distal end, a first surface, and a second surface, said distal end comprising (i) a first distal surface adjacent to said first surface;

(ii) a second distal surface adjacent to said second surface; and (iii) a third distal surface between said first and second distal surfaces;

(b) an integral spring extending upward from the first surface of said wedge member and from the distal end thereof, said integral spring comprising a generally planar member;

(c) a first positive stop means extending from an opposite second side of said wedge member and on the proximal end thereof, and comprising a central body with a stop surface dimensioned to prevent insertion into said adapter assembly beyond a predetermined distance;

(d) a second positive stop means extending from said integral spring comprising a rigid outwardly projecting portion, formed on a proximal end of said integral spring, having an upwardly facing engagement surface.

18. The locking pin of claim 17 wherein said distal end further comprises said first, said second, and said third distal surface such that a first distal angle exists between the first surface and the first distal surface, a second distal angle exists between the first and third distal surfaces, a third distal angle exists between the second and third distal surfaces, and a fourth distal angle exists between the second surface and the second distal surfaces, each of said first, second, third, and fourth distal angles being greater than or equal to 90 degrees.

* * * * *